US010100543B2

(12) United States Patent
Hanson

(10) Patent No.: US 10,100,543 B2
(45) Date of Patent: Oct. 16, 2018

(54) DETACHMENT DEVICE AND MATERIAL DETACHMENT PROCESS

(71) Applicant: John Hanson, Surrey (CA)

(72) Inventor: John Hanson, Surrey (CA)

( * ) Notice: Subject to any disclaimer, the term of this patent is extended or adjusted under 35 U.S.C. 154(b) by 288 days.

(21) Appl. No.: 14/503,719

(22) Filed: Oct. 1, 2014

(65) Prior Publication Data

US 2015/0107077 A1 Apr. 23, 2015

(30) Foreign Application Priority Data

Oct. 1, 2013 (CA) ..... 2829255

(51) Int. Cl.
*B66F 15/00* (2006.01)
*E04G 23/08* (2006.01)

(52) U.S. Cl.
CPC ..... *E04G 23/08* (2013.01); *E04G 2023/085* (2013.01); *Y10T 29/49815* (2015.01); *Y10T 29/49822* (2015.01); *Y10T 29/53* (2015.01)

(58) Field of Classification Search
CPC ..... B25F 1/006; B66F 15/00; E04G 23/08; E04G 2023/085; Y10T 29/49822; Y10T 29/49821; Y10T 29/49815
USPC ..... 7/166; 254/131, 25
See application file for complete search history.

(56) References Cited

U.S. PATENT DOCUMENTS 2,593,304 A * 4/1952 Howard ..... A01K 55/00 15/236.05
2,921,773 A * 1/1960 Hoelzer ..... B65G 7/12 254/129
3,049,337 A * 8/1962 Griggs ..... E04G 23/08 254/131
3,134,574 A * 5/1964 Reuterfors ..... E04G 23/08 254/131
3,987,827 A * 10/1976 Mills ..... E04D 15/003 254/25
4,745,651 A * 5/1988 Schellenger ..... B66F 15/00 254/131.5
5,207,126 A * 5/1993 Schaben ..... E04D 15/003 254/25

(Continued)

FOREIGN PATENT DOCUMENTS

CA 1063092 9/1979
CA 2323740 9/2000

*Primary Examiner* — Jermie Cozart
(74) *Attorney, Agent, or Firm* — Ladas & Parry LLP; Malcolm J. MacDonald

(57) ABSTRACT

A detachment device especially of use as a material detachment device for detaching installed drywall is described. The detachment device has a material-engagement portion and a handle portion. The material-engagement portion has a beveled free end. The handle portion has a handle free end, is engaged with the material-engagement portion, and is transverse to the material-engagement portion. The material-engagement portion and the handle portion are shaped and configured to wholly or partly detach either or both installed material (such as drywall) and one or more attachment members (such as nails, screws, or dabs or beads of glue). A material detachment process especially of use as a drywall detachment process is also described which includes two analogous steps preceded by accessing (a) the installed material and (b) the one or more structural members (such as studs) to which the installed material is attached by one or more attachment members.

18 Claims, 4 Drawing Sheets

(56) References Cited

U.S. PATENT DOCUMENTS 5,322,264 A * 6/1994 Giambro ..... B25C 11/00 254/25
5,325,576 A * 7/1994 Henderson ..... B23P 19/041 254/17
5,695,171 A * 12/1997 Shine ..... E04D 15/003 254/25
5,695,172 A * 12/1997 Hreha ..... B25C 11/00 254/18
5,813,295 A * 9/1998 Jensen, Jr. ..... E04D 15/04 254/21
5,850,657 A * 12/1998 List ..... A47L 13/08 15/105
6,257,553 B1 * 7/2001 Khachatoorian ..... B66F 15/00 254/21
6,302,375 B1 * 10/2001 Heil ..... B66F 15/00 254/131
6,598,857 B1 * 7/2003 Hernandez ..... B66F 15/00 254/21
6,641,113 B1 * 11/2003 Budinich ..... B66F 15/00 254/131
6,644,627 B1 * 11/2003 Forrester ..... B66F 15/00 254/131
6,663,083 B1 * 12/2003 Smith ..... B25C 11/00 254/131
6,715,734 B1 * 4/2004 Wise ..... B25C 11/00 254/25
6,786,472 B1 * 9/2004 Dahl ..... B25B 31/00 254/25
6,901,644 B1 * 6/2005 Rich ..... B25B 27/04 29/275
6,959,473 B1 * 11/2005 Anibas ..... B25B 27/00 29/239
6,959,917 B2 * 11/2005 Hernandez ..... B66F 15/00 254/21
6,962,326 B2 * 11/2005 Else ..... B66F 15/00 254/25
7,278,626 B1 * 10/2007 Chang ..... B66F 15/00 254/25
7,503,545 B2 * 3/2009 Verbowski ..... B25G 1/10 254/21
7,520,199 B2 * 4/2009 Stawarski ..... B25G 1/06 81/177.7
7,618,031 B2 * 11/2009 Weaver ..... B66F 15/00 269/131
7,669,506 B2 * 3/2010 Cox ..... E04D 15/003 254/131.5
7,735,806 B2 * 6/2010 Prater ..... B25B 27/00 254/25
8,079,290 B2 * 12/2011 Cox ..... E04D 15/003 81/45
8,215,617 B2 * 7/2012 Liou ..... B66F 15/00 254/131
8,297,596 B2 * 10/2012 Su ..... B66F 15/00 254/129
8,365,378 B1 * 2/2013 Lenart ..... B25B 33/00 15/236.01
8,511,207 B2 * 8/2013 Su ..... B25G 1/06 254/25
8,573,561 B2 * 11/2013 Su ..... B66F 15/00 254/129
8,707,492 B2 * 4/2014 Conibear ..... B25F 1/006 7/145
8,763,225 B2 * 7/2014 Bruce ..... B25B 27/02 29/270
8,955,827 B2 * 2/2015 Brown ..... B25C 11/00 254/21
9,265,976 B1 * 2/2016 Hensley ..... A62B 3/005
9,302,385 B2 * 4/2016 Su ..... B25G 1/06
2004/0026674 A1 * 2/2004 Hernandez ..... B66F 15/00 254/25
2005/0062026 A1 * 3/2005 Holcomb ..... E04D 15/00 254/25
2005/0127339 A1 * 6/2005 Else ..... B66F 15/00 254/25
2007/0158626 A1 * 7/2007 Chang ..... B66F 15/00 254/25
2008/0001129 A1 * 1/2008 Weaver ..... B66F 15/00 254/25
2008/0191181 A1 * 8/2008 Verbowski ..... B66F 15/00 254/25
2009/0230369 A1 * 9/2009 Kurtz ..... B66F 15/00 254/131
2010/0140575 A1 * 6/2010 Liou ..... B66F 15/00 254/131.5
2010/0207082 A1 * 8/2010 Liou ..... B25G 1/06 254/131
2012/0102699 A1 * 5/2012 Bruce ..... B25B 27/02 29/275
2012/0192360 A1 * 8/2012 Conibear ..... B25F 1/006 7/166
2013/0160214 A1 * 6/2013 Brown ..... B25F 1/006 7/158
2016/0024807 A1 * 1/2016 Raymond ..... E04G 23/08 29/426.5

* cited by examiner

DETACHMENT DEVICE AND MATERIAL DETACHMENT PROCESS

BACKGROUND OF THE PRESENT INVENTION

The present invention pertains to detachment devices and to material detachment processes. More particularly, the present invention pertains to a detachment device especially of use as a material detachment device for detaching installed drywall and to a material detachment process especially of use as a drywall detachment process.

Drywall detachment is commonly part of removal of installed drywall. More particularly, drywall is commonly installed horizontally or vertically by attaching 4'-wide drywall sheets to studs that are 1' to 2' from one another. Still more particularly, it is common that drywall is installed vertically in most commercial and residential applications and horizontally for walls in warehousing above 12 feet. In turn, removal of installed drywall commonly comprises detachment of installed drywall, followed by conveying the detached drywall to another location for reuse or disposal, and by cleanup of the dust and other debris from the detachment and from the conveying.

SUMMARY OF THE PRIOR ART

Prior art is apparently only general background to the present invention.

For example, as compared to what is disclosed in Canadian Patents 2,323,740 and 1,063,092, the present invention more readily facilitates removal of installed drywall in larger pieces, and more cleanly and compactly, as well as potentially with less damage to studs, than has heretofore apparently been provided for.

SUMMARY OF THE INVENTION

Disadvantages of prior art detachment devices and of prior art material detachment processes, and especially the disadvantages of commonly smaller detached drywall piece size and of commonly higher debris volume from the detachment and from the conveying as well as of damage to studs, may be overcome according to the present invention.

According to the present invention, there is provided a detachment device especially of use as a material detachment device for detaching installed drywall, comprising material-engagement means comprising a beveled free end and handle means comprising a handle free end, and engaged with said material-engagement means and transverse to said material-engagement means, said material-engagement means and said handle means being shaped and configured to wholly or partly detach either or both of installed material and one or more attachment members by which said installed material is attached to one or more structural members, through single or multiple application of either or both of engagement of said beveled free end between said installed material and said one or more structural members to which said installed material is attached by said one or more attachment members and once said beveled free end is in engagement between said installed material and said one or more structural members to which said installed material is attached by said one or more attachment members, rotation of said handle means transversely of said material-engagement means.

Also according to the present invention, there is provided a material detachment process for detaching installed material from one or more structural members to which said installed material is attached by one or more attachment members and especially of use as a drywall detachment process, comprising single or multiple application of a set of steps to wholly or partly detach either or both of said installed material and one or more of said one or more attachment members from said one or more structural members to which said installed material is attached by said one or more attachment members:

as a first step, accessing said installed material and said one or more structural members to which said installed material is attached by said one or more attachment members, as a second step, engaging material-engagement means of a detachment device between said installed material and said one or more structural members to which said installed material is attached by said one or more attachment members, and as a third step, once said material-engagement means of a detachment device is in engagement between said installed material and said one or more structural members to which said installed material is attached by said one or more attachment members, rotating said detachment device transversely of said material-engagement means

BRIEF DESCRIPTION OF THE DRAWINGS

In drawings which illustrate embodiments of the invention.

DETAILED DESCRIPTION OF THE PREFERRED EMBODIMENT

Referring especially to FIGS. 1, 2, 3A, and 3B, construction and use of the preferred embodiment of the detachment device according to the invention will be described; and referring especially to FIG. 4, the preferred embodiment of the material detachment process according to the invention will be described.

Figure 1:
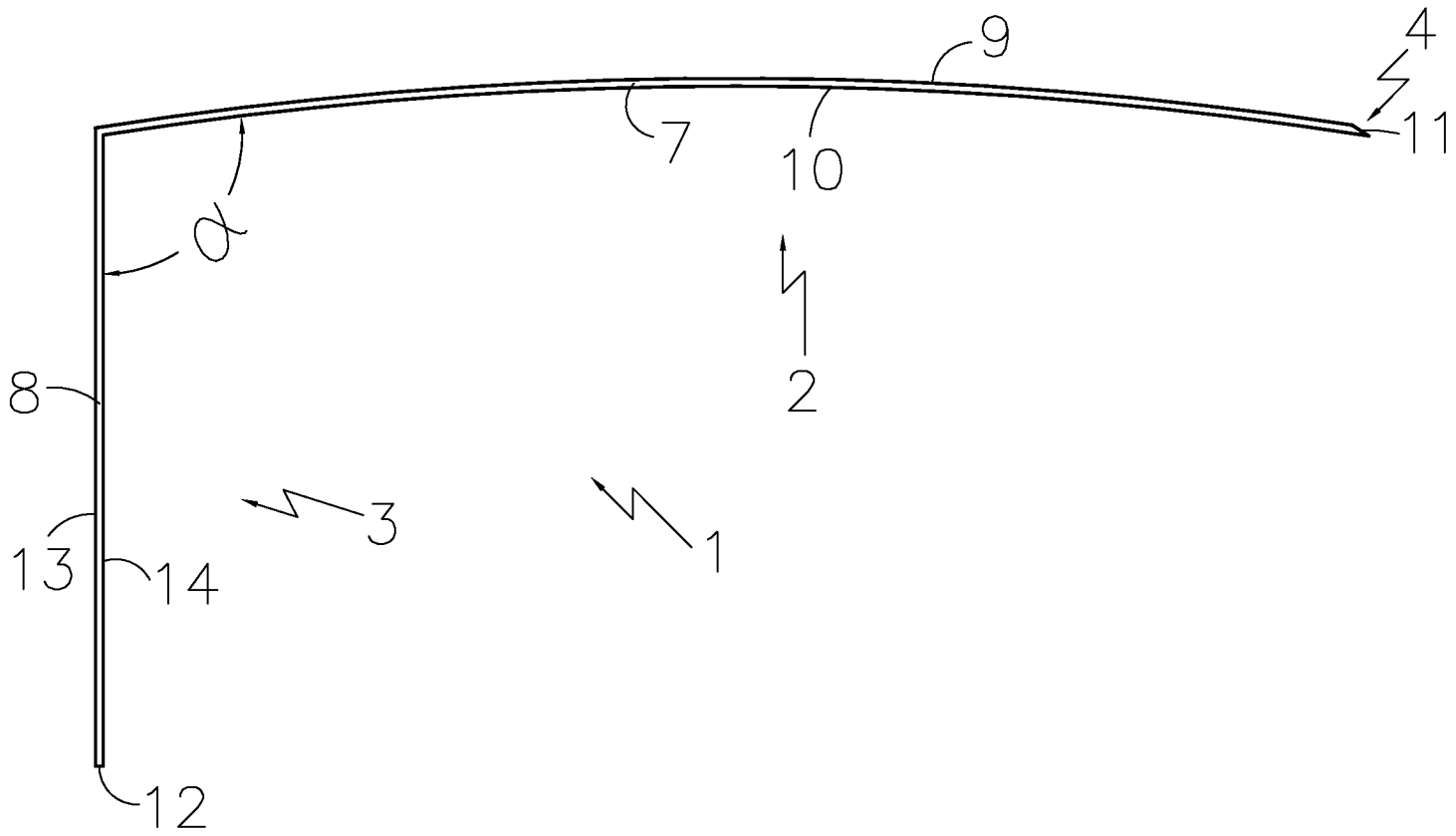
FIG. 1 is a profile view, of an embodiment of the detachment device according to the invention.
Figure 2:
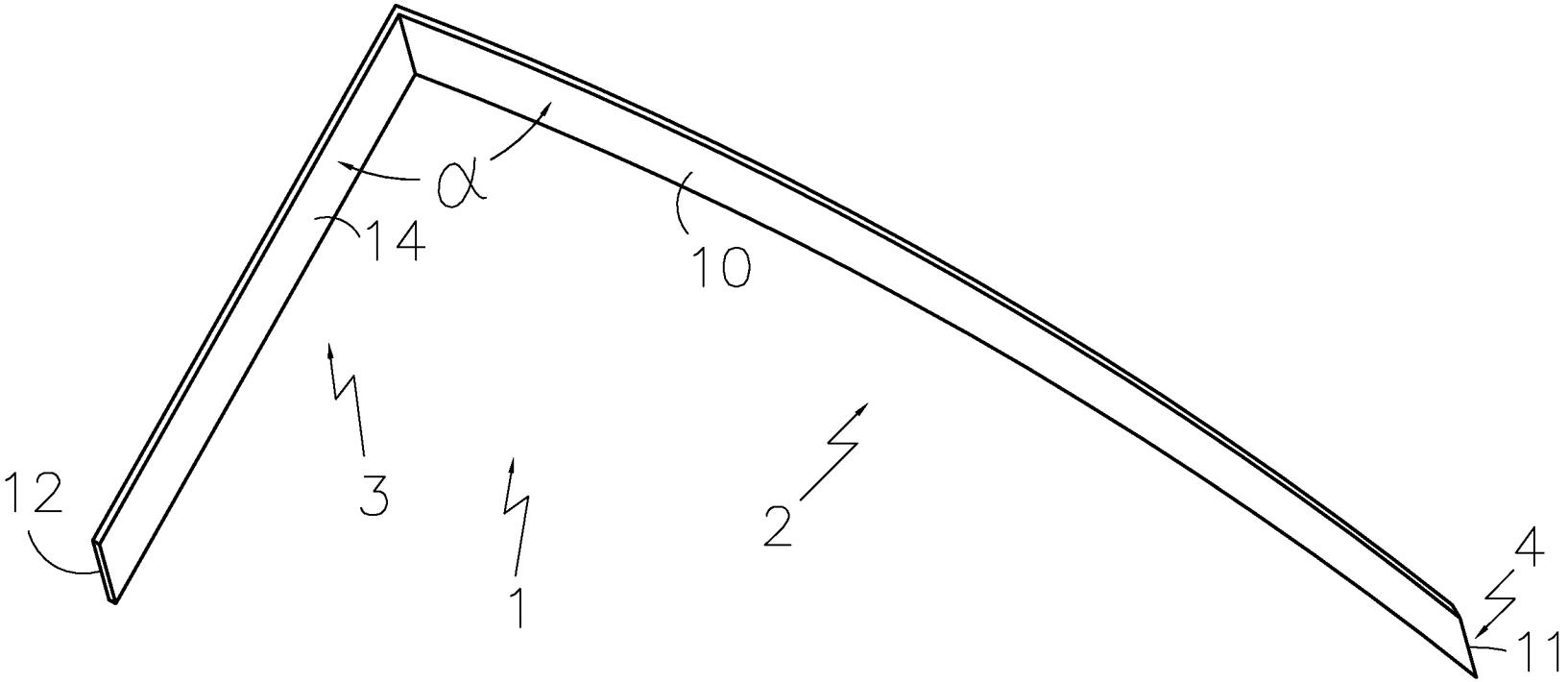
FIG. 2 is an isometric view, of the embodiment shown in FIG. 1.
Figure 4:
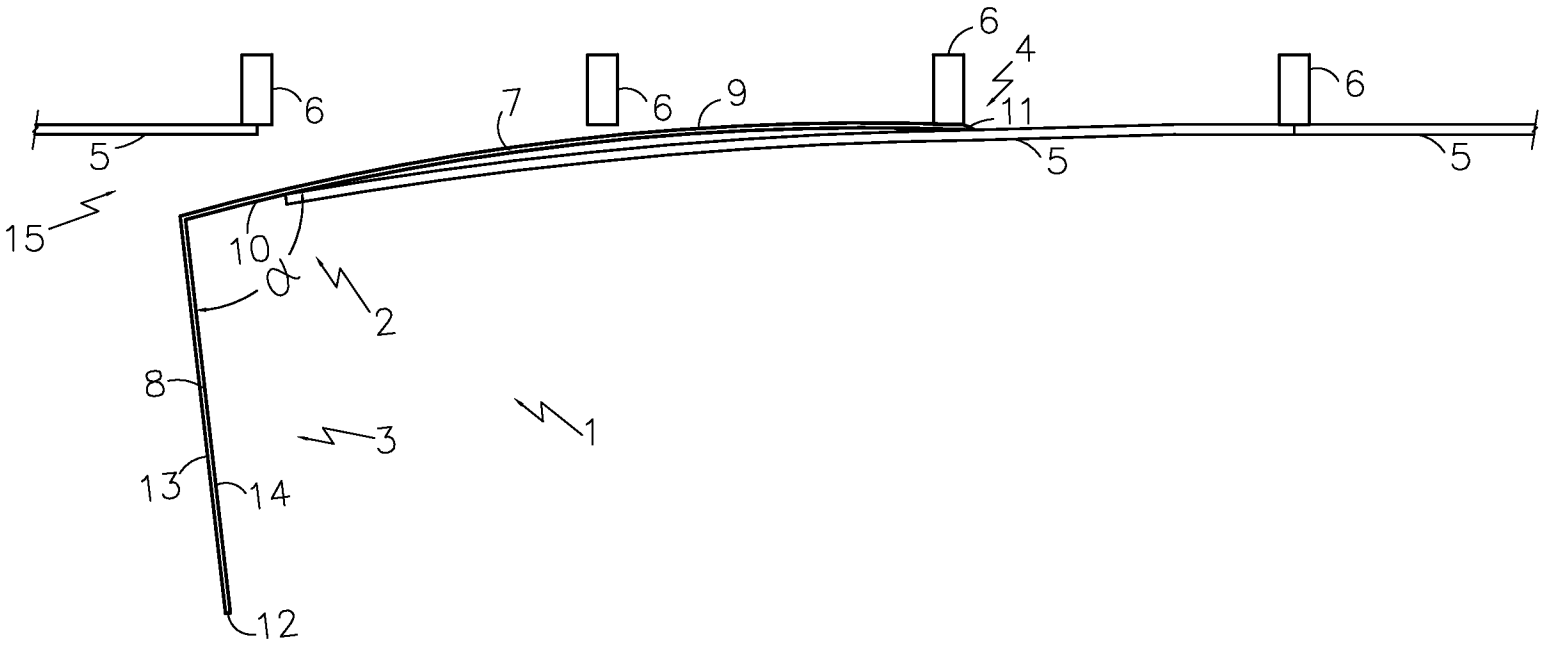
FIG. 4 is a plan view, of an embodiment of the material detachment process according to the invention.

Referring to FIGS. 1, 2, and 4, detachment device 1 comprises material-engagement means 2 and handle means 3. Material-engagement means 2 comprises beveled free end 4 for engagement between installed material 5 (such as drywall shown in FIG. 4) and one or more structural members 6 (such as studs shown in FIG. 4) to which installed material 5 is attached by one or more attachment members such as nails, screws, or dabs or beads of glue (not shown). Handle means 3 is for generally positioning material-engagement means 2, for particularly positioning beveled free end 4 by engaging beveled free end 4 between installed material 5 and the one or more structural members 6, and, once beveled free end 4 is in engagement between installed material 5 and the one or more structural members 6, for then effecting rotation transversely of material-engagement means 2.

Referring to FIGS. 1, 2, 3A, and 3B, in the preferred embodiment of detachment device 1, material-engagement means 2 comprises material-engagement means 2 largely orthogonal to handle means 3. More particularly, material-engagement means 2 comprises material-engagement means 2 integral with and largely orthogonal to handle means 3. Still more particularly, material-engagement means 2 and handle means 3 comprise a device, and, even more particularly, a strip, of largely L-shaped profile respectively comprising a first arm 7 and a second arm 8, with an inner angle $\alpha$ between first arm 7 and second arm 8. First arm 7 comprises an outer face 9 and, adjacent inner angle $\alpha$, an inner face 10; beveled free end 4 comprises beveling 11 of outer face 9 inwardly from outer face 9. Second arm 8 comprises handle free end 12, an outer face 13 and, adjacent inner angle $\alpha$, an inner face 14.

Referring to FIGS. 1, 2, and 4, to facilitate beveled free end 4 being engaged between installed material 5 (such as drywall shown in FIG. 4) and one or more structural members 6 (such as studs shown in FIG. 4), and to facilitate rotation of handle means 3 transversely of material-engagement means 2, the preferred embodiment of detachment device 1 comprises further shaping, and further configuration, of material-engagement means 2 and handle means 3. More particularly, in the preferred embodiment of detachment device 1, first arm 7 has lengthwise deviation from the largely L-shaped profile, outwardly from inner angle $\alpha$, such that displacement between beveled free end 4 and handle free end 12 is less, and inner angle $\alpha$ is equal to or greater, than if the lengthwise deviation were not present. That lengthwise deviation imparts a spring-like effect to detachment device 1, resulting in an aspect of the above-mentioned facilitation of engagement and of rotation.

As used in this disclosure and in the accompanying claims, the expression "displacement ratio" means the ratio of (a) displacement between beveled free end 4 and handle free end 12 when the lengthwise deviation is present to (b) displacement between beveled free end 4 and handle free end 12 when the lengthwise deviation is not present.

In the preferred embodiment of detachment device 1, each of inner angle $\alpha$ and displacement ratio can be selected from a range; the range of degrees of inner angle $\alpha$ is approximately 70 degrees to approximately 110 degrees and the range of displacement ratio is approximately 0.996 to approximately 0.998. The best inner angle $\alpha$ value is approximately 90 degrees and the best displacement ratio value is approximately 0.997.

Also more particularly, in the preferred embodiment of detachment device 1, the lengthwise deviation comprises rectilinear deviation, and, still more particularly, curvilinear deviation approximated by rectilinear deviation.

As well, in the preferred embodiment of detachment device 1, first arm 7 and second arm 8 are, in length ratio to one another, approximately 2:1 and, more particularly, first arm 7 and second arm 8 are respectively, in length, approximately 40" long and approximately 20" long. For those particular lengths, the strip is of an at least medium carbon steel (such as 1144 A311 CLB(CF)) squelched at its ends as well as between first arm 7 and second arm 8 and at each deviation, and is approximately 3/16" thick and approximately 2" wide. A detachment device 1 of that steel type, and having first arm 7 and second arm 8 of those respective lengths and of that thickness and that width, tends to especially be of use as a material detachment device for detaching ½"-thick installed drywall in 4'-wide sheets; that is especially so, because drywall is commonly installed horizontally or vertically by attaching 4'-wide drywall sheets to studs that are 1' to 2' from one another.

Figure 3B:
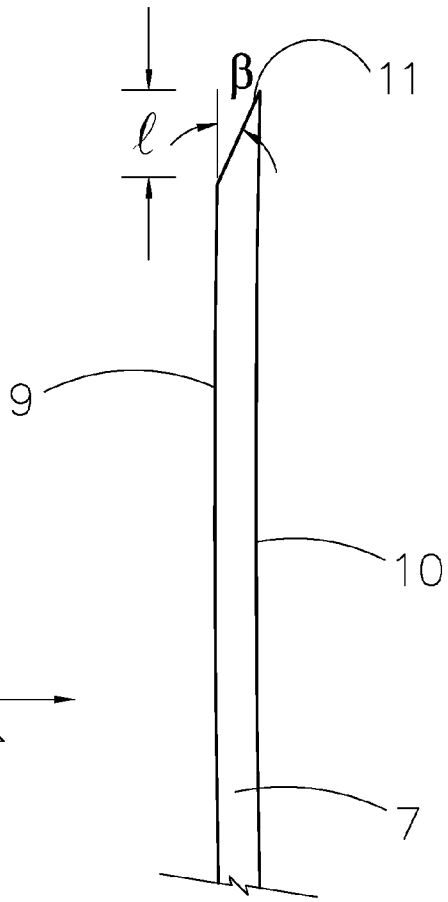
FIG. 3B is a detail profile view of the beveled free end, of the embodiment shown in FIG. 1.
Figure 3A:
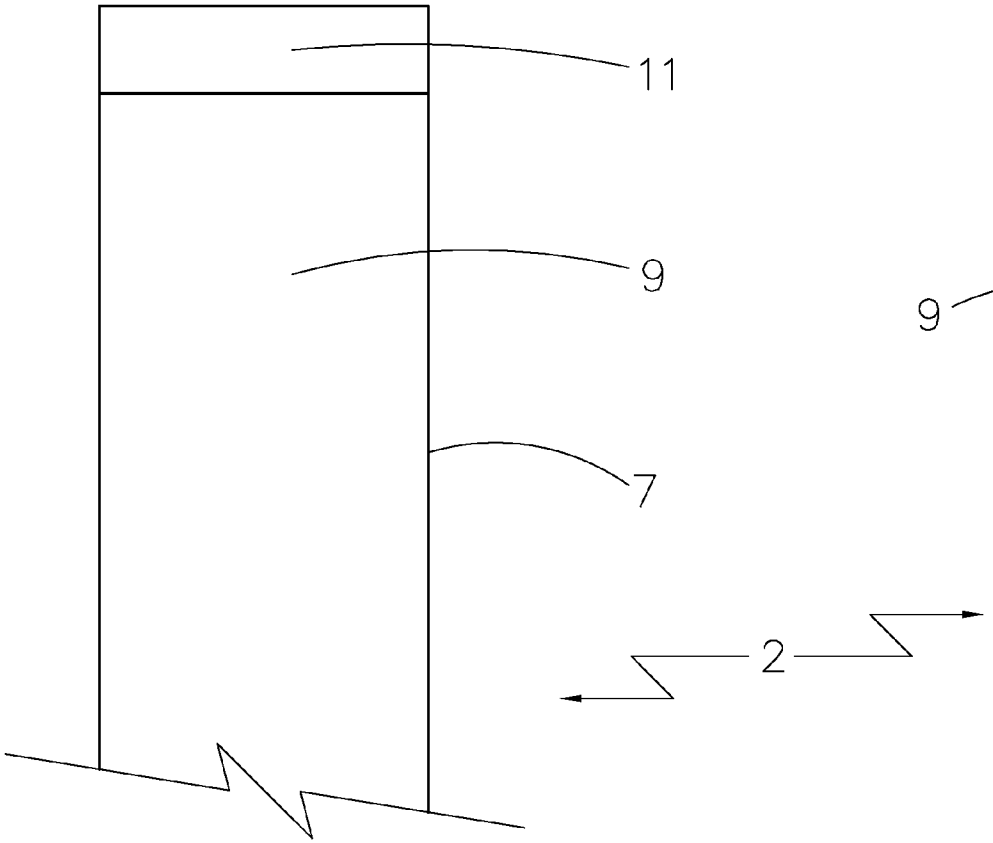
FIG. 3A is a detail plan view of the beveled free end, of the embodiment shown in FIG. 1.

Referring to FIGS. 3A, 3B, and 4, beveling 11 comprises beveling at a constant angle as measured inwardly from outer face 9. More particularly, beveling 11 comprises beveling at a constant angle as measured inwardly from and lengthwise of outer face 9. Still more particularly, beveling 11 comprises beveling at constant angle $\beta$ as measured inwardly from and lengthwise of outer face 9 and has constant length l as measured lengthwise of outer face 9. Each of constant angle $\beta$ and constant length l can be selected from a range; the range of degrees of constant angle $\beta$ is approximately 20 degrees to approximately 30 degrees and the range of lengths of constant length l is approximately 0.325" to approximately 0.515". The best constant angle $\beta$ value is approximately 30 degrees and the best constant length l value is approximately 0.325".

The preferred embodiment of detachment device 1 is constructed from 1144 A311 CLB(CF) planar steel sheet of a uniform thickness of approximately 3/16", by first cutting from that sheet a strip approximately 2" wide and approximately 60" long; then, at one end of that strip, the edges of what will become second arm 8 are rounded by grinding as are the corners of what will become handle free end 12, for the safety of people making or handling the detachment device 1. Beveled free end 4 is then formed at the opposite end of that strip by grinding a face of that opposite end to produce beveled free end 4 depicted especially in FIGS. 3A and 3B. Then, that strip is bent to form first arm 7, second arm 8, inner angle $\alpha$ between first arm 7 and second arm 8, and the lengthwise deviation of each of first arm 7 and second arm 8 from what would otherwise be a largely L-shaped profile; that lengthwise deviation is outwardly from inner angle $\alpha$, such that displacement between beveled free end 4 and handle free end 12 is less, and inner angle $\alpha$ is equal to or greater, than if the lengthwise deviation were not present. Lastly, to increase the hardness of portions of the device 1, the above-mentioned squelching should be done.

Referring to FIG. 4, the preferred embodiment of the material detachment process according to the invention is especially of use as a drywall detachment process. The material detachment process is for detaching installed material 5 (such as drywall shown in FIG. 4) from one or more structural members 6 (such as studs shown in FIG. 4) to which installed material 5 is attached by one or more attachment members such as nails, screws, or dabs or beads of glue (not shown).

Drywall removal commonly includes, as preparatory steps, removing casings from doorways and other openings, removing corner bead and L-edge, removing baseboards and ceiling trim, and, at room corners to which drywall tape and drywall mud were applied, cutting through that tape and that mud; it also commonly includes then removing any attachment members that appear as a result. Especially if installed material 5 is drywall overlapped by a floor or ceiling (such as by the floor or ceiling having been added after drywall installation) or installed tight to a floor or ceiling, then the material detachment process of the invention comprises a supplementary step before the second step; more particularly, that supplementary step is before the first step. The supplementary step comprises cutting into installed material 5 parallel to a horizontal edge of installed material 5, and more particularly, cutting into installed material 5 parallel to a horizontal edge of installed material 5 at approximately 2" above the flooring or, as the case may be, at approximately 2" below the ceiling, such that, in general that cut is at approximately 2" from that horizontal edge, such that installed material 5 will fold back towards one or more structural members 6 as installed material 5 is detached.

The first step (of accessing installed material 5 and one or more structural members 6 to which installed material 5 is attached by one or more attachment members) comprises, in its first instance, making an opening 15, through installed material 5. That is done either of two ways. One way is such as by drilling and sawing, between structural members 6 to which installed material 5 is attached by one or more attachment members; the other way is such as by prying, on-seam between respective sheets of installed material 5 (having first removed or cut through whatever had been applied to that seam) either at the preferred location of an outside corner or otherwise. Opening 15 is shaped and configured to allow the second step and the third step. After the first instance of the first step, the third step provides the accessing prescribed by second and subsequent instances of the first step.

The second step (of engaging material-engagement means of a detachment device, such as beveled free end 4 of detachment device 1, between installed material 5 and one or more structural members 6 to which installed material 5 is attached by one or more attachment members) comprises, in its first instance, inserting material-engagement means of a detachment device, such as beveled free end 4 of detachment device 1, through opening 15 and engaging that material-engagement means between installed material 5 and one or more structural members 6 to which installed material 5 is attached by one or more attachment members. Second and subsequent instances of the second step do not have to include inserting material-engagement means of a detachment device, other than by the first instance of the second step; that is because the material-engagement means of the detachment device can remain behind installed material 5 and near one or more structural members 6 to which installed material 5 is attached by one or more attachment members, rather than, for example, the material-engagement means being withdrawn through opening 15 and then re-inserted through opening 15. If installed material 5 is 4'-wide drywall sheets installed horizontally, then engaging the material-engagement means of the detachment device used in the second step and in the third step (such as detachment device 1), is largely upward from horizontal or largely downward from horizontal, to detach installed material 5 in full sheets, or is largely horizontal, to detach installed material 5 in less than full sheets such as approximately 4' sections.

The third step (of, once material-engagement means of a detachment device is in engagement between the installed material 5 and one or more structural members 6 to which the installed material 5 is attached by one or more attachment members, rotating the detachment device, such as the detachment device according to the invention, transversely of the material-engagement means) comprises, in its first and subsequent instances, the accessing prescribed by second and subsequent instances of the first step. Also, rotating the detachment device (such as the detachment device according to the invention) transversely of the material-engagement means of that detachment device comprises rotating that detachment device largely orthogonally of the material-engagement means. If the engaging done in the second step is largely horizontal, then the rotating done in the third step may be either largely upward from horizontal or largely downward from horizontal; if the engaging done in the second step is largely downward from horizontal, then the rotating done in the third step is largely upward from horizontal; and if the engaging done in the second step is largely upward from horizontal, then the rotating done in the third step is largely downward from horizontal.

Depending on the circumstances, one or more of the following three cautions may apply regarding either or both of the detachment device according to the invention and the material detachment process according to the invention: (1) if installed material 5 is other than ½"-thick drywall, such as, for example, ⅝"-thick drywall, then, in the material detachment process according to the invention, either or both of more force and more repetition may be needed; (2) because the present invention more readily facilitates removal of installed drywall in larger pieces than has heretofore apparently been provided for, those larger pieces might be more unwieldy than heretofore expected, so caution should be exercised accordingly, and, especially if the drywall sheets are installed vertically, bringing such larger pieces into contact with sprinkler heads should be guarded against; and (3) because the present invention more readily facilitates removal of installed drywall more compactly than has heretofore apparently been provided for, haulage load maximum weight limits might be reached at lesser load volumes than heretofore expected.

The claimed embodiments of the present invention are as follows:

1. A detachment device comprising:

an elongated material-engagement part comprising opposite first and second ends, wherein the second end of the material-engagement part comprises a beveled free end, and wherein the material-engagement part has a length such that the material-engagement part is insertable between installed material and at least two structural members spaced 1 to 2 feet apart from each other; and a handle part comprising opposite first and second ends, wherein the second end of the handle part comprises a free end, and wherein the first end of the handle part is engaged with the first end of the material-engagement part such that the material-engagement part and the handle part form a substantially L-shaped profile defining an inner angle between the material-engagement part and the handle part, with the handle part being substantially transverse to said material-engagement part;

wherein said material-engagement part comprises an outer face and, adjacent said inner angle, an inner face; and wherein said beveled free end comprises beveling of said outer face inwardly from said outer face;

wherein the material-engagement part has a length of approximately 40 inches;

wherein a ratio of the length of the material-engagement part to the length of the handle part is approximately 2:1; and wherein said material-engagement part and said handle part are shaped and configured to wholly or partially detach said installed material from said two or more structural members spaced 1 to 2 feet apart from each other.

2. The detachment device according to claim 1, wherein said material-engagement part curves concavely along its length in a direction towards said handle part.

3. The detachment device according to claim 1, wherein said material-engagement part is integral with, and substantially orthogonal to, said handle part.

4. The detachment device according to claim 1, wherein said material-engagement part has a lengthwise curvilinear deviation from said substantially L-shaped profile, outwardly from said inner angle.

5. The detachment device according to claim 1, wherein said inner angle is in a range between approximately 70 degrees and approximately 110 degrees.

6. The detachment device according to claim 1, wherein said inner angle is approximately 90 degrees.

7. The detachment device according to claim 1, wherein said beveling of said outer face inwardly from said outer face comprises beveling at a constant angle as measured inwardly from said outer face.

8. The detachment device according to claim 7, wherein said beveling at a constant angle, as measured inwardly from said outer face, comprises beveling at a constant angle as measured inwardly from and lengthwise of said outer face.

9. The detachment device according to claim 8, wherein said beveling at a constant angle, as measured inwardly from and lengthwise of said outer face, comprises beveling of constant length, as measured lengthwise of said outer face.

10. The detachment device according to claim 8, wherein said constant angle, as measured inwardly from and lengthwise of said outer face, is in a range of approximately 20 degrees and approximately 30 degrees.

11. The detachment device according to claim 9, wherein said constant length, as measured lengthwise of said outer face, is in a range of approximately 0.325 inch and approximately 0.515 inch.

12. The detachment device according to claim 9, wherein said constant angle, as measured inwardly from and lengthwise of said outer face, is in a range of approximately 20 degrees and approximately 30 degrees, and said constant length, as measured lengthwise of said outer face, is in a range of approximately 0.515 inch and approximately 0.325 inch.

13. The detachment device according to claim 12, wherein said constant angle, as measured inwardly from and lengthwise of said outer face, is approximately 30 degrees.

14. The detachment device according to claim 9, wherein said constant length, as measured lengthwise of said outer face, is approximately 0.325 inch.

15. The detachment device according to claim 9, wherein said constant angle, as measured inwardly from and lengthwise of said outer face, is approximately 30 degrees, and said constant length, as measured lengthwise of said outer face, is approximately 0.325 inch.

16. The detachment device according to claim 1, wherein the detachment device is made from a strip of medium carbon steel squelched at its ends and between the material-engagement part and the handle part.

17. The detachment device according to claim 16, wherein the strip of medium carbon steel has a thickness of approximately 3/16 inches and a width of approximately 2 inches.

18. A material detachment method comprising:

accessing installed material and two or more structural members to which said installed material is attached using a detachment device comprising:

an elongated material-engagement part comprising opposite first and second ends, wherein the second end of the material-engagement part comprises a beveled free end, and wherein the material-engagement part has a length such that the material-engagement part is insertable between installed material and at least two structural members spaced 1 to 2 feet apart from each other; and a handle part comprising opposite first and second ends, wherein the second end of the handle part comprises a free end, and wherein the first end of the handle part is engaged with the first end of the material-engagement part such that the material-engagement part and the handle part form a substantially L-shaped profile defining an inner angle between the material-engagement part and the handle part, with the handle part being substantially transverse to said material-engagement part;

wherein said material-engagement part comprises an outer face and, adjacent said inner angle, an inner face; and wherein said beveled free end comprises beveling of said outer face inwardly from said outer face;

wherein the material-engagement part has a length of approximately 40 inches;

wherein a ratio of the length of the material-engagement part to the length of the handle part is approximately 2:1; and wherein said material-engagement part and said handle part are shaped and configured to wholly or partially detach said installed material from said two or more structural members spaced 1 to 2 feet apart from each other;

engaging the material-engagement part of the detachment device between said installed material and said two or more structural members; and rotating said detachment device transversely of said material-engagement part to wholly or partially detach the installed material from at least one of the structural members.

* * * * *